US006615725B2

(12) United States Patent
Kurata et al.

(10) Patent No.: US 6,615,725 B2
(45) **Date of Patent: *Sep. 9, 2003**

(54) PRINTING PRESS AND PRINTING PRESS CONTROL METHOD

(75) Inventors: Yoshiaki Kurata, Ibaraki (JP); Hideki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/859,742

(22) Filed: May 16, 2001

(65) Prior Publication Data

US 2001/0042482 A1 Nov. 22, 2001

(30) Foreign Application Priority Data

May 17, 2000 (JP) ..... 2000/145562

(51) Int. Cl.[7] ..... B41F 1/54

(52) U.S. Cl. ..... 101/483; 101/365; 101/467; 101/478; 101/484

(58) Field of Search ..... 101/365, 467, 101/478, 483, 484

(56) References Cited

U.S. PATENT DOCUMENTS

| | | | | |
|---|---|---|---|---|
| 5,206,102 A | * | 4/1993 | Tench | 101/456 |
| 5,237,923 A | | 8/1993 | Williams et al. | |
| 5,379,698 A | | 1/1995 | Nowak et al. | |
| 5,884,562 A | | 3/1999 | Sugiyama et al. | |
| 5,921,184 A | | 7/1999 | Sugiyama et al. | |
| 5,988,067 A | * | 11/1999 | Ishida et al. | 101/183 |
| 6,101,944 A | * | 8/2000 | Schmid et al. | 101/463.1 |

FOREIGN PATENT DOCUMENTS

| | | |
|---|---|---|
| DE | 19723311 | 12/1998 |
| EP | 0867279 | 9/1998 |
| EP | 0878303 | 11/1998 |
| JP | 63-127923 | 5/1988 |
| JP | 63-134244 | 6/1988 |
| JP | 2-258993 | 10/1990 |
| JP | 2-286245 | 11/1990 |
| JP | 3-114748 | 5/1991 |
| JP | 5-200995 | 8/1993 |
| JP | 9-039215 | 2/1997 |
| JP | 10-016193 | 1/1998 |
| JP | 10-193578 | 7/1998 |
| JP | 10-286944 | 10/1998 |

* cited by examiner

*Primary Examiner*—Charles H. Nolan, Jr.
(74) *Attorney, Agent, or Firm*—Blakely, Sokoloff, Taylor & Zafman

(57) ABSTRACT

A printing press includes a blanket cleaning controller, automatic plate change unit, image exposing section, pre-inking controller, and CPU. The blanket cleaning controller cleans a blanket mounted on a blanket cylinder. The automatic plate change unit changes a printing plate mounted on a plate cylinder to a new printing plate. The image exposing section exposes an image on the printing plate mounted on the plate cylinder. The pre-inking controller forms, on an ink roller group, an ink film thickness distribution corresponding to an image to be exposed next. The CPU automatically drives the blanket cleaning controller, automatic plate change unit, image exposing section, and pre-inking controller in an operation order set by a start command.

7 Claims, 11 Drawing Sheets

PRINTING PRESS AND PRINTING PRESS CONTROL METHOD

BACKGROUND OF THE INVENTION

The present invention relates to a printing press and, more particularly, to a printing press having a on-machine plate making function of exposing an image on a printing plate mounted on a plate cylinder and an ink film thickness control function.

[On-machine Plate Making]

Recently, to improve the efficiency of plate making and register accuracy, a printing press has been designed to directly perform plate making by using a plate making apparatus incorporated in the printing press itself. That is, a graphic pattern (image) is exposed on a printing plate (raw plate) mounted on a plate cylinder by irradiating it with a laser beam from the head of a plate making apparatus incorporated in a printing unit instead of using a plate making apparatus provided independently of the printing press. This operation is called on-machine plate making.

More specifically, the printing press is accelerated to a designated rotational speed. When the rotational speed is stabilized, laser radiation (exposure) from the head to a raw plate is started. Thereafter, the head is moved in the axial direction of the plate cylinder during exposure to expose an image on the entire plate. The exposure time is determined by the size of the plate and the designated rotational speed during exposure. As a technique of exposing an image on a raw plate by laser radiation, the technique disclosed in U.S. Pat. No. 5,379,698 (reference 1) is incorporated in this specification.

FIG. 8 shows how plate making apparatuses are incorporated in a four-color web offset printing press. Referring to FIG. 8, reference numerals 1-1 to 1-4 denote printing units for the respective ink colors. Plate making apparatuses 2-1 to 2-4 are respectively incorporated in the printing units 1-1 to 1-4. The plate making apparatuses 2-1 to 2-4 are normally located at the positions indicated by the chain double-dashed lines in FIG. 8 and brought near to plate cylinders 3 in the printing units 1-1 to 1-4 when exposure is performed. Reference numeral 4 denotes a blanket cylinder which is in contact opposite to the plate cylinder and on which a blanket is mounted. Impression cylinders (not shown) are respectively placed below the blanket cylinders 4.

FIG. 9 shows the main part of a plate making apparatus 2. The plate making apparatus 2 includes an exposure apparatus 2*b* having a head 2*a*. The exposure apparatus 2*b* is fixed on a table 2*c*. The table 2*c* moves in the axial direction (the direction indicated by arrows A and B in FIG. 9) of the plate cylinder 3 while being guided by rails 2*f*1 and 2*f*2 on a stage 2*f*. A raw plate 5 before plate making is mounted on the plate cylinder 3.

[Ink Film Thickness Control]

To adjust the amount of ink to be supplied and decrease the number of times of test printing until a desired tone is obtained, an ink film thickness control method like that disclosed in U.S. Pat. Nos. 5,884,562 (reference 2) and 5,921,184 (reference 3) has been proposed. These references disclose ink film thickness control methods called "pre-inking 1" and "pre-inking 2". According to the ink film thickness control methods disclosed in these references, when a printing plate is set in the plate cylinder for the first time, an ink film thickness distribution is formed in the inking device by "pre-inking 1". When an old printing plate is to be changed to a new printing plate, an ink film thickness distribution is formed in the inking device by "pre-inking 2".

The technique disclosed in references 1 and 2 is incorporated in this specification.

FIG. 10 shows the main part of the inking device (inker) in a printing unit 1. Reference numeral 6 denotes an ink fountain; 7, an ink stored in the ink fountain 6; 8, an ink fountain roller; 9, a plurality of ink fountains aligned in the axial direction of the ink fountain roller 8; 10, an ink ductor roller; 11, an ink roller group; and 12, a printing plate on which an image has already been exposed.

In the inking device having this arrangement, the ink 7 is supplied from the ink fountain 6 onto the surface of the ink fountain roller 8 through a portion between the ink fountain key 9 and the ink fountain roller 8. The ink supplied to the ink fountain roller 8 is supplied to the printing plate 12 via the ink roller group 11 upon ink feed operation of the ink ductor roller 10. The ink supplied to the printing plate 12 is printed on printing paper.

When the old printing plate is changed to the new printing plate 12, the opening amount of the ink fountain key 9, the rotation amount of the ink fountain roller 8, and the like are preset to values corresponding to the image on the printing plate 12. More specifically, by setting the opening amount of the ink fountain key 9, the rotation amount of the ink fountain roller 8, and the like to the values corresponding to the image on the printing plate 12, the ink 7 in the ink fountain 6 is supplied to the printing plate 12 via the ink roller group 11. In this case, test printing is performed before final printing to obtain a satisfactory tone while adjusting the amount of ink to be supplied. With this operation, a desired ink film thickness distribution (ink film thickness gradient) is formed on the ink roller group 11.

When the old printing plate is changed to the new printing plate 12, the ink film thickness distribution is left on the ink roller group 11. For the new printing plate 12, this ink film thickness distribution for the old printing plate must be gradually changed to an ink film thickness distribution suited to the new printing plate 12. For this reason, to obtain a satisfactory tone, adjustment of the amount of ink to be supplied and test printing are required to excessive degrees, resulting in problems, e.g., an increase in printing preparation time, an increase in work load, a waste of printing materials, a decrease in production efficiency, and an increase in cost.

According to references 2 and 3 described above, when the old printing plate is to be changed to the printing plate 12, ink removing operation is performed first. More specifically, ink removing is selected on a display (not shown) after a printing unit is selected. In ink removing operation, the ink feed operation of the ink ductor roller 10 is set in the OFF state, and the printing press is driven while the old printing plate is mounted to print out a predetermined number of sheets. With this operation, as shown in FIG. 11A, a minimum ink film thickness distribution Ma required during printing is left on the ink roller group 11, which decreases in thickness from upstream to downstream. That is, the basic ink film thickness distribution Ma corresponding to a portion of the printing plate 12 which has no image is left.

Pre-inking 2 is then selected on the display to perform operation of pre-inking 2. In pre-inking 2, after the opening amount of the ink fountain key 9, the rotation amount of the ink fountain roller 8, and the like are preset to values corresponding to the image on the printing plate 12, the printing press is driven, and the ink feed operation of the ink ductor roller 10 is performed a predetermined number of times. With this operation, as shown in FIG. 11B, an ink film thickness distribution (to be referred to as image ink film thickness distribution hereinafter) Mb corresponding to the image on the printing plate 12 is superimposed on the basic ink film thickness distribution Ma left on the ink roller group 11.

After the image ink film thickness distribution Mb is superimposed on the basic ink film thickness distribution Ma, test printing corresponding to a predetermined number of sheets is performed while the printing plate is changed to the new printing plate 12, thereby performing density checks on printing products produced by test printing. In the density checks, if a satisfactory tone is obtained, ink film thickness control by "pre-inking 2" is terminated, and final printing is started.

If the ink roller group 11 holds no ink, e.g., the printing plate 12 is mounted on the surface of the plate cylinder 3 for the first time, a printing unit is selected on the display first, and then pre-inking 1 is selected. In pre-inking 1, the total opening amount of the ink fountain keys 9 is initialized to a reference opening amount (e.g., 50%), and the rotation amount of the ink fountain roller 8 is initialized to a reference rotation amount (e.g., 50%). In this state, the printing press is driven, and the ink feed operation of the ink ductor roller 10 is performed a predetermined number of times to form the basic ink film thickness distribution Ma on the ink roller group 11. After the basic ink film thickness distribution Ma is formed, the opening amount of the ink fountain key 9 and the rotation amount of the ink fountain roller 8 are preset to values corresponding to the image on the new printing plate 12. The ink feed operation of the ink ductor roller 10 is then performed a predetermined number of times to superimpose the image ink film thickness distribution Mb corresponding to the printing plate 12 on the basic ink film thickness distribution Ma formed on the ink roller group 11.

In this state, test printing corresponding to a predetermined number of sheets is performed, and density checks are made on printing products produced by test printing. In these density checks, if a satisfactory tone is obtained, ink film thickness control by "pre-inking 1" is terminated, and final testing is started.

[On-machine Plate Making+Ink Film Thickness Control and Final Printing]

Conventionally, a series of operations ranging from plate making to final printing and including the above on-machine plate making and ink film thickness control are serially performed. FIG. 12A shows the conventional steps in performing on-machine plate making and ink film thickness distribution formation by pre-inking 2. FIG. 12B shows the conventional steps in performing on-machine plate making and ink film thickness distribution formation by pre-inking 1. In either case, a preparatory process (ink removing, cleaning of the impression cylinder and blanket, paper size/paper thickness presetting, plate change, and the like) is performed before on-machine plate making and ink film thickness control.

Referring to FIG. 12A, first of all, ink removing is performed while an old printing plate is mounted on the plate cylinder 3 (step S21) to leave the basic ink film thickness distribution Ma on the ink roller group 11. After ink removing, the impression cylinder and blanket are cleaned (step S22). Concurrently with this cleaning operation, a paper size/paper thickness is preset (step S23). An automatic plate change unit (not shown) is driven to change the old printing plate mounted on the plate cylinder 3 with a raw plate (step S24).

The plate making apparatus 2 is then driven to perform exposure, thereby exposing an image on the raw plate 5 (step S25). Pre-inking 2 is performed (step S26) to superimpose the image ink film thickness distribution Mb corresponding to the image exposed on the raw plate 5 on the basic ink film thickness distribution Ma left on the ink roller group 11. After the image ink film thickness distribution Mb is superimposed, test printing is performed (step S27). If a satisfactory tone is obtained, the flow advances to final printing (step S28).

The exposure time in step S25 is determined by the size of a plate and a designated rotational speed in exposure. According to a conventional, standard plate making method, the exposure time is about 3 min and 40 sec. According to a conventional, standard ink film thickness control method, it takes about 1 min and 30 sec to form an ink film thickness distribution by pre-inking 2 in step S26.

Referring to FIG. 12B, the flow starts with a preparatory process including cleaning of the impression cylinder, blanket, and inker, paper size/paper thickness presetting, and plate change. That is, the impression cylinder, blanket, and inker are cleaned (step S11). Concurrently with this cleaning operation, paper size/paper thickness presetting is performed (step S12). The old printing plate mounted on the plate cylinder 3 is changed to the raw plate 5 by using the automatic plate change unit (step S13). The plate making apparatus 2 is then driven to perform exposure so as to expose an image on the raw plate 5 (step S14). Pre-inking 1 is performed (step S15) to form the ink film thickness distributions Ma and Mb. After the formation of the ink film thickness distributions Ma and Mb, test printing is performed (step S16). If a satisfactory tone is obtained, the flow advances to final printing (step S17).

The exposure time in step S14 is determined by the size of a plate and the designated rotational speed in exposure. According to a conventional, standard plate making method, the exposure time is about 3 min and 40 sec. It takes about 2 min and 30 sec to form an ink film thickness distribution by pre-inking 1 in step S15.

As described above, however, in the prior art, the operator sequentially performs the respective operations ranging from on-machine plate making to ink film thickness control and final printing. Referring to FIG. 12A, the operator selects ink removing on the display to perform ink removing (step S21). Upon checking the end of ink removing, the operator selects cleaning of the impression cylinder/blanket on the display to clean the impression cylinder and blanket (step S22). Concurrently with this cleaning operation, the operator selects paper size/paper thickness presetting on the display to preset a paper size/paper thickness (step S23).

Subsequently, the flow sequentially advances to automatic plate change in step S24, exposure in step S25, pre-inking 2 in step S26, test printing in step S27, and final printing in step S28 when the operator selects each operation to be performed next in the same manner as described above. This process imposes a heavy load on the operator and prolongs the time required for the flow to advance to final printing.

SUMMARY OF THE INVENTION

It is an object of the present invention to provide a printing press which reduces the load on an operator and has a plate making function and ink film thickness control function, and a control method for the printing press.

It is another object of the present invention to provide a printing press which shortens the time required to start final printing and has a plate making function and ink film thickness control function, and a control method for the printing press.

In order to achieve the above objects, according to the present invention, there is provided a printing press comprising blanket cleaning means for cleaning a blanket mounted on a blanket cylinder, plate change means for changing a printing plate mounted on a plate cylinder to a new printing plate, image exposing means for exposing an image on the printing plate mounted on the plate cylinder, ink film thickness distribution formation means for forming, on an ink roller group, an ink film thickness distribution corresponding to an image to be exposed next, and control means for automatically driving the blanket cleaning means, the plate change means, the image exposing means, and the ink film thickness distribution formation means in an operation order set by a start command.

DESCRIPTION OF THE PREFERRED EMBODIMENT

The present invention will be described in detail below with reference to the accompanying drawings.

[Combination of On-machine Plate Making and Pre-inking 2]

Figure 1A:
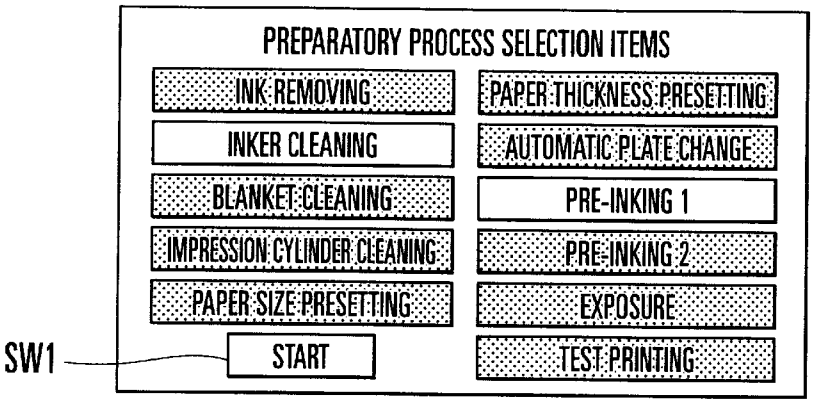
FIG. 1A is a view showing how preparatory selection items are selected.
Figure 1B:
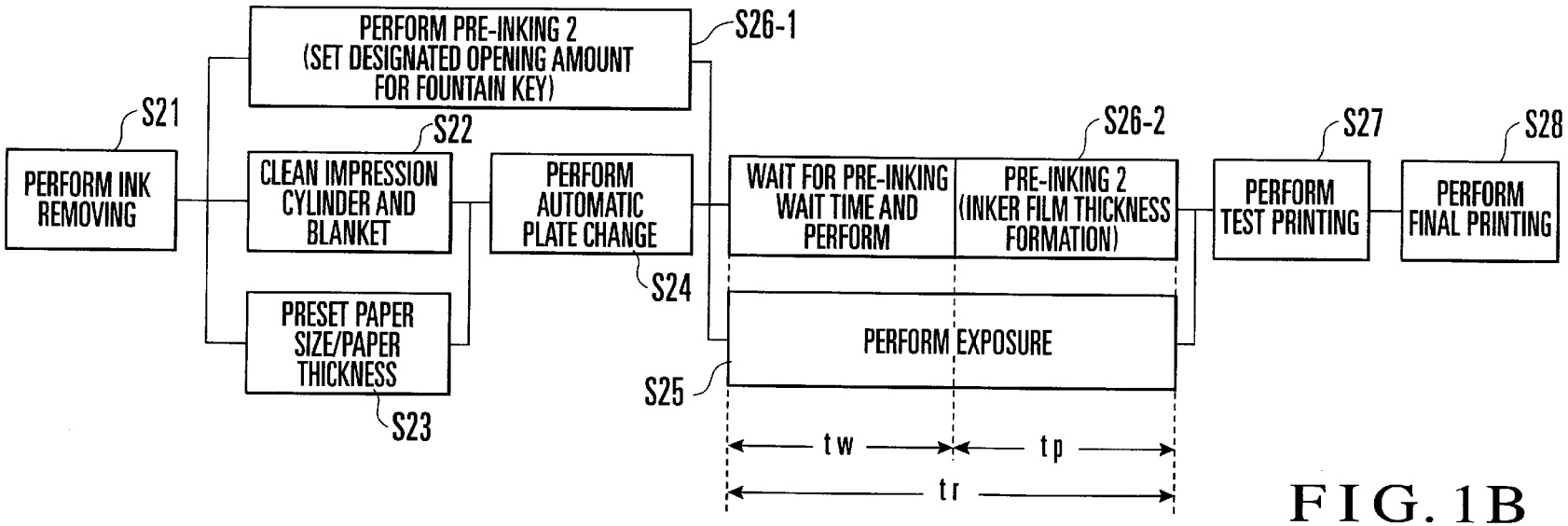
FIG. 1B is a view showing the steps in continuous processing for on-machine plate making and ink film thickness distribution formation by pre-inking 2 in accordance with the selection operation in FIG. 1A.
Figure 8:
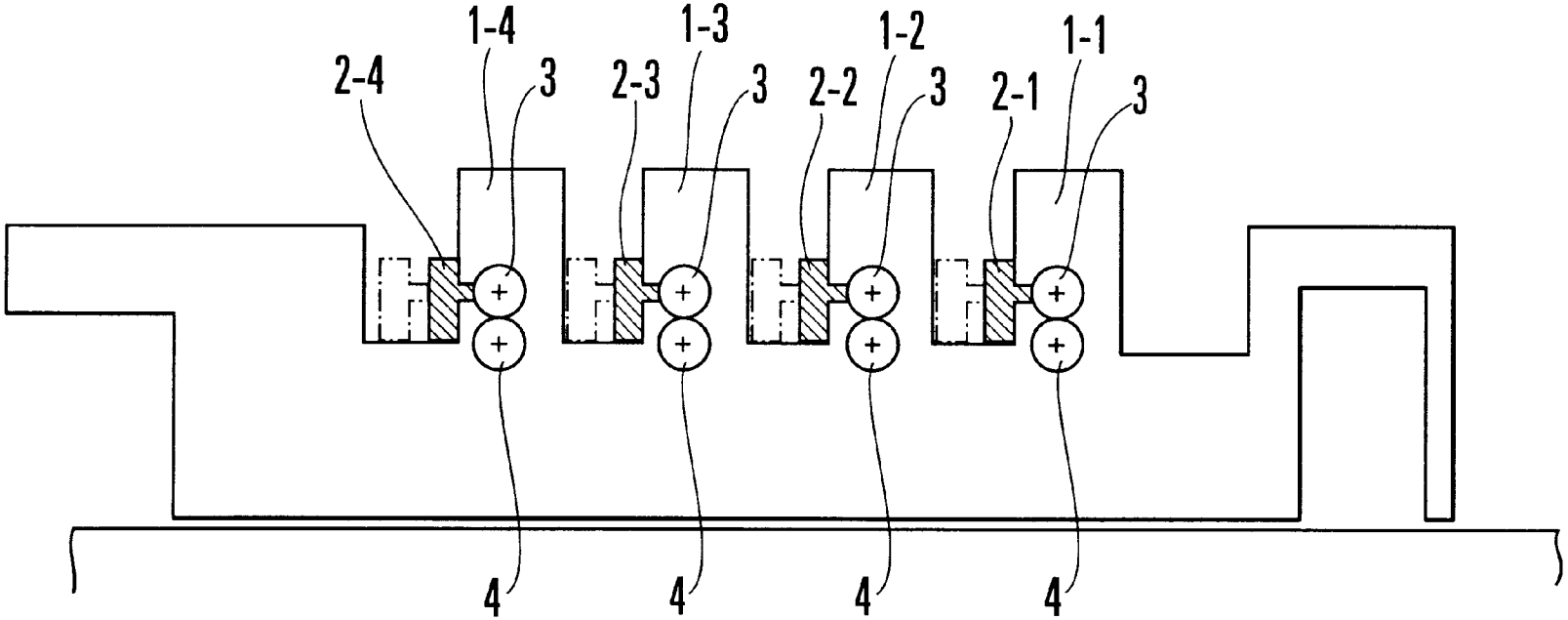
FIG. 8 is a side view of a four-color web offset printing press incorporating plate making apparatuses.
Figure 9:
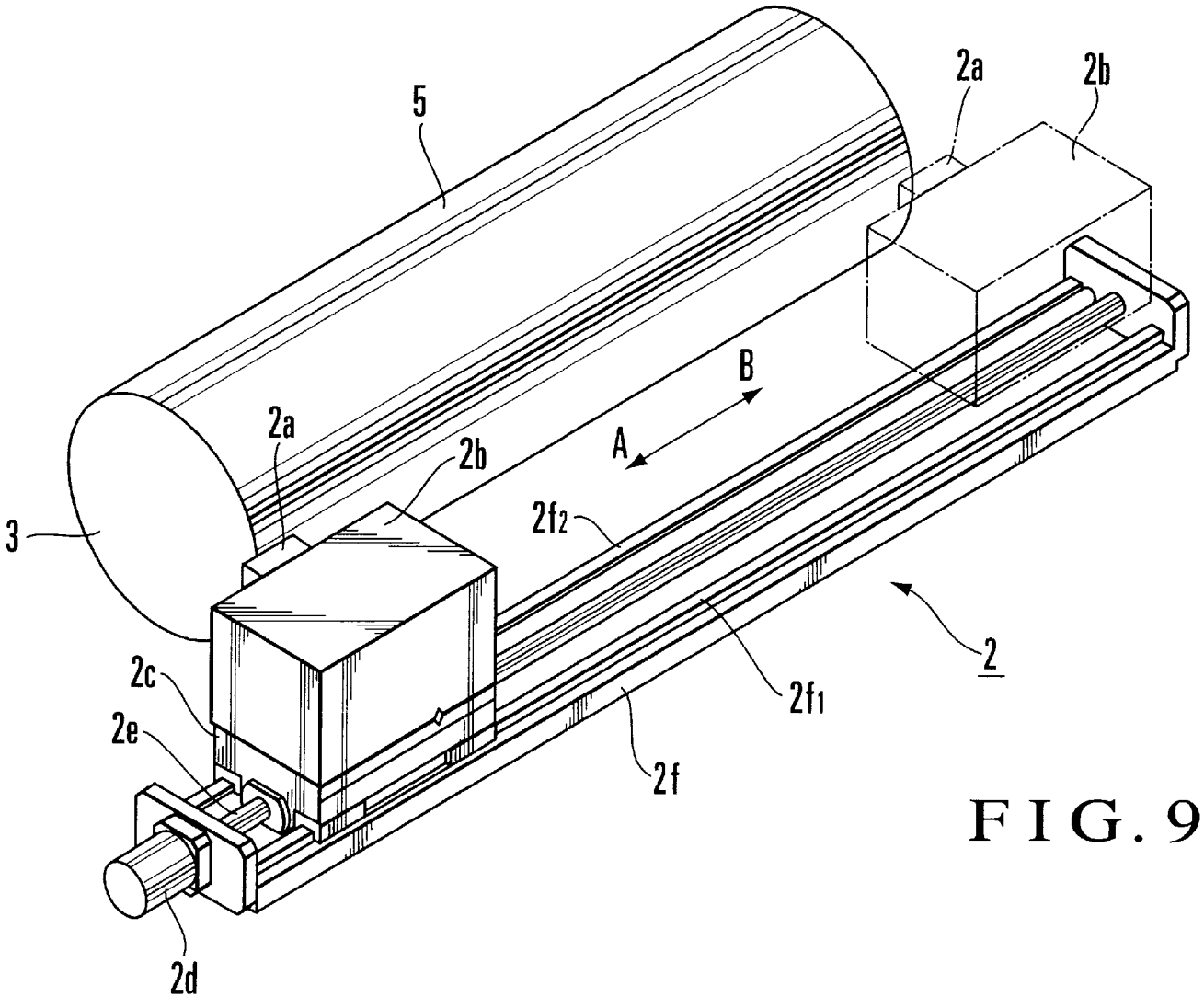
FIG. 9 is a perspective view showing the main part of the plate making apparatus.
Figure 10:
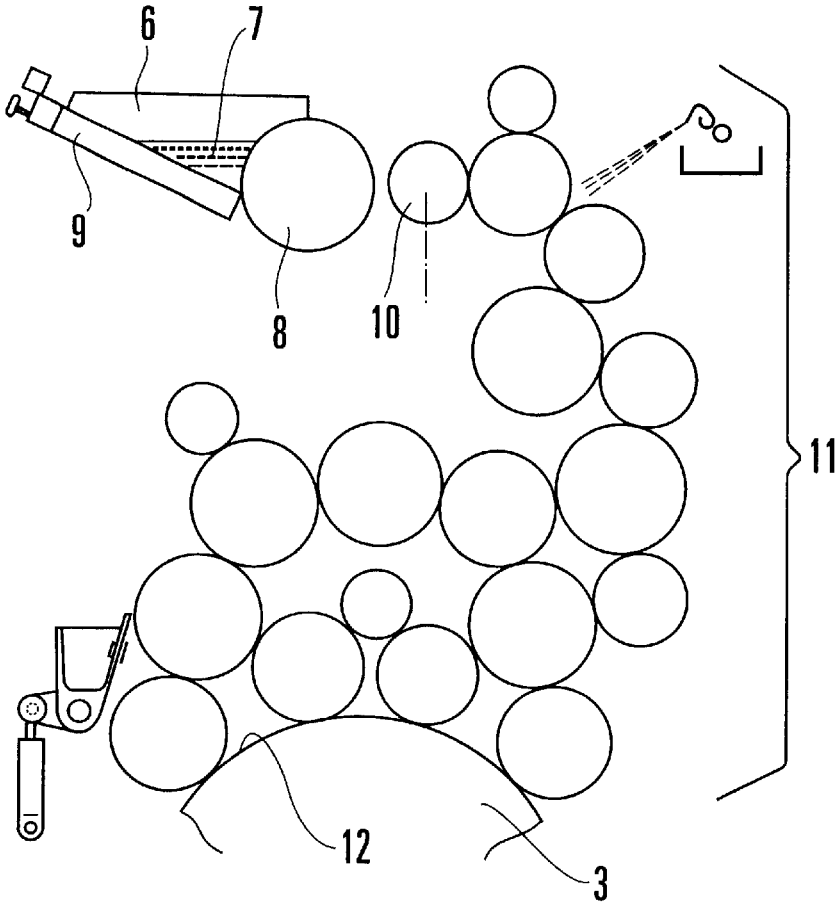
FIG. 10 is a schematic view of an inking device (inker) in a printing unit.
Figure 11A:
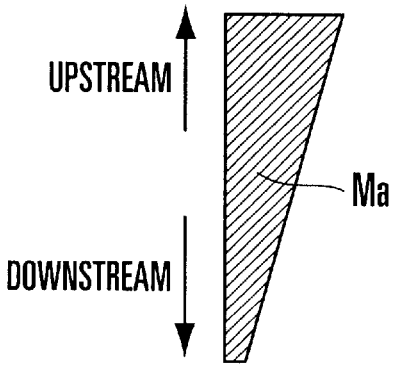
FIGS. 11A and 11B are views showing ink film thickness distributions Ma an Mb formed on the ink roller group of the inking device.
Figure 11B:
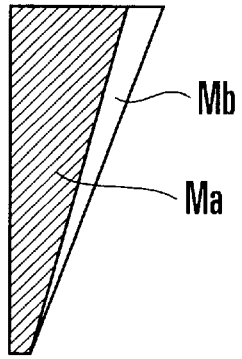
Figure 12A:
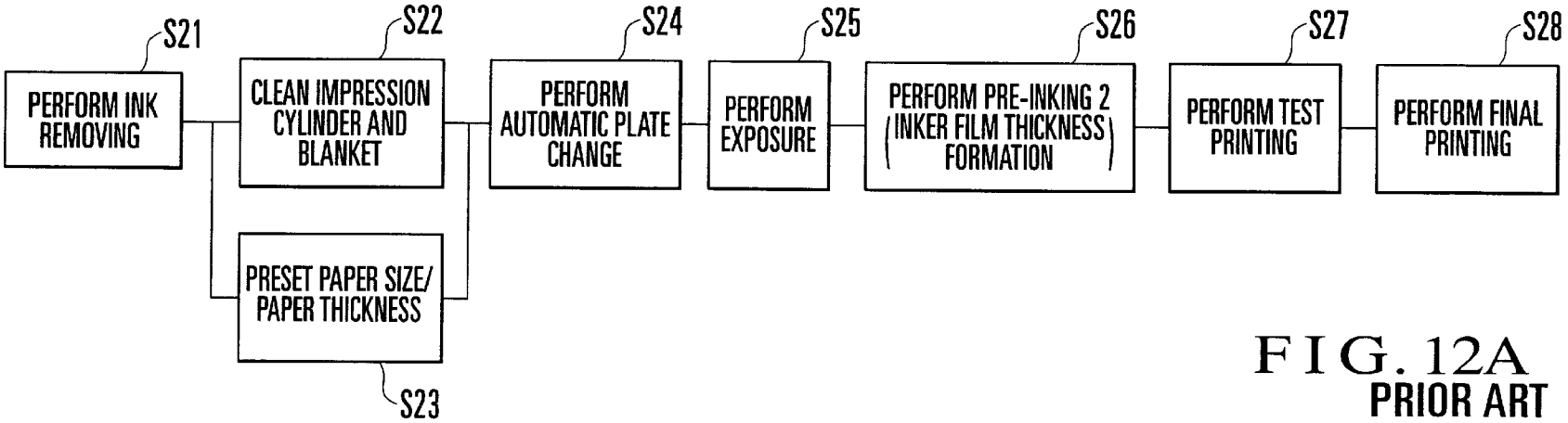
FIG. 12A PRIOR ART
FIGS. 12A and 12B are views showing the conventional steps in performing on-machine plate making and ink film thickness distribution formation by pre-inking.

FIG. 1B shows the steps in performing on-machine plate making and ink film thickness distribution formation by pre-inking 2 in combination. FIG. 1B corresponds to FIG. 12A showing the conventional steps. The arrangement of a printing press will be described with reference to FIGS. 8 to 10.

An operator selects and designates an operation to be performed on a display. FIG. 1A shows how operations are selected by the operator. In this example, the operator has selected "ink removing", "blanket cleaning", "impression cylinder cleaning", "paper size presetting", "paper thickness presetting", "automatic plate change", "pre-inking 2", "exposure", and "test printing". In this case, the order of operations is automatically determined in accordance with the combination of selected operations. This determination can be done by looking up a table 14*b* (FIG. 3) in which combinations of operations and operation orders corresponding to the combinations are stored in advance.

When the preceding printing operation is switched to the next printing operation, a start command is output by operating a start switch SW1, and the operations corresponding to selected items are automatically performed in a predetermined order. These operations are continuously operated as a series of operations up to the step before final printing. That is, the operation is only required to select all operations to be performed on the display and press the start switch SW1. This makes it possible to reduce the load on the operator and shorten the time required to start final printing.

In the steps in FIG. 1B, when the start switch SW1 is pressed, ink removing is automatically performed while an old printing plate 12 is mounted on a plate cylinder 3 (step S21). With this operation, a basic ink film thickness distribution Ma is left on an ink roller group 11. After ink removing, the impression cylinder and blanket are automatically cleaned (step S22). Concurrently with this cleaning operation, paper size/paper thickness presetting is automatically performed (step S23). After the cleaning and presetting operations, the automatic plate change unit is driven to change the old printing plate mounted on the plate cylinder 3 to a raw plate 5 (step S24).

After automatic plate change, exposure and ink film thickness distribution formation by pre-inking 2 are automatically performed. In this case, exposure (step S25) and ink film thickness distribution formation by pre-inking 2 (step S26-2) are concurrently performed, and the start timing of ink film thickness distribution formation by pre-inking 2 is delayed to simultaneously terminate the two operations.

Referring to FIG. 1A, the step of presetting the opening amount of an ink fountain key 9 to a value corresponding to an image to be exposed on a raw plate 5 (setting designated ink fountain key opening amount; step S26), which is one of the steps in forming an ink film thickness distribution by pre-inking 2, is executed concurrently with a preparatory process. The preparatory process is constituted by cleaning of the impression cylinder and blanket (step S22), paper size/paper thickness presetting (step S23), and automatic plate change (step S24). An operation time (designated ink fountain key opening amount setting time) tp4 taken to preset the opening amount of the ink fountain key 9 to a designated opening amount is excluded from a time (pre-inking time) tp taken to form an ink film thickness distribution by pre-inking 2, as indicated by equation (1) described later.

There is a difference between an exposure time tr and the time tp taken to form an ink film thickness distribution by pre-inking 2. In general, the time tp taken to form an ink film thickness distribution by pre-inking 2 is shorter than the exposure time tr. If, therefore, exposure and ink film thickness distribution formation by pre-inking 2 are simultaneously started, the exposure is not completed even after the completion of ink film thickness distribution formation by pre-inking 2. In this case, since the printing press keeps rotating until the exposure is completed, the ink film thickness distribution changes. As a consequence, a desired ink film thickness distribution may not be obtained when the exposure is completed, and test printing may be prolonged.

In this embodiment, the start timing of ink film thickness distribution formation by pre-inking 2 is delayed to simultaneously terminate the exposure and ink film thickness distribution formation by pre-inking 2. The time tp taken to form an ink film thickness distribution by pre-inking 2 varies depending on the image area ratio of an image to be exposed on the raw plate 5. The exposure time tr is determined by the size of the raw plate 5 and a designated rotational speed in exposure.

First of all, therefore, the exposure time tr and the time tp taken to form an ink film thickness distribution by pre-inking 2 are calculated. Then, the time tp taken to form an ink film thickness distribution by pre-inking 2 is subtracted from the exposure time tr to calculate a wait time tw (=tr−tp) between the instant at which exposure is started and the instant at which ink film thickness distribution formation by pre-inking 2 is started. This wait time tw will be termed as a pre-inking wait time.

The time tp taken to form an ink film thickness distribution by pre-inking 2 is obtained from a time (fountain roller portion designated ink film thickness distribution formation time) tp5 taken for ink film thickness formation on an ink fountain roller 8 and a time (inker portion designated ink film thickness distribution formation time) tp6 taken for ink film thickness distribution formation on an ink roller group 11 according to equation (11):

$$tp=tp5+tp6 \quad (1)$$

Note that the fountain roller portion designated ink film thickness distribution formation time tp5 is the value obtained by adding the time spent to preset the rotation amount of the ink fountain roller 8 to a value (designated rotation amount) corresponding to the image to be exposed on the raw plate 5 to the time spend to form an ink film having the thickness specified by the designated opening amount of the ink fountain key 9 preset in step S26-1 up to a portion on the ink fountain roller 8 which is in contact with an ink ductor roller 10. The inker portion designated ink film thickness distribution formation time tp6 is the time spent to superimpose an ink film thickness distribution (designated ink film thickness distribution) Mb corresponding to the image to be exposed on the raw plate 5 on a basic ink film thickness distribution Ma left on the ink roller group 11 by performing ink feed operation of the ink ductor roller 10 a predetermined number of times.

The time required to start final printing can further be shortened by concurrent execution of exposure and ink film thickness distribution formation by pre-inking 2, i.e., concurrent execution of exposing of an image on the raw plate 5 and ink film thickness distribution formation by pre-inking 2.

[Combination of On-machine Plate Making and Pre-inking 1]

Figure 2A:
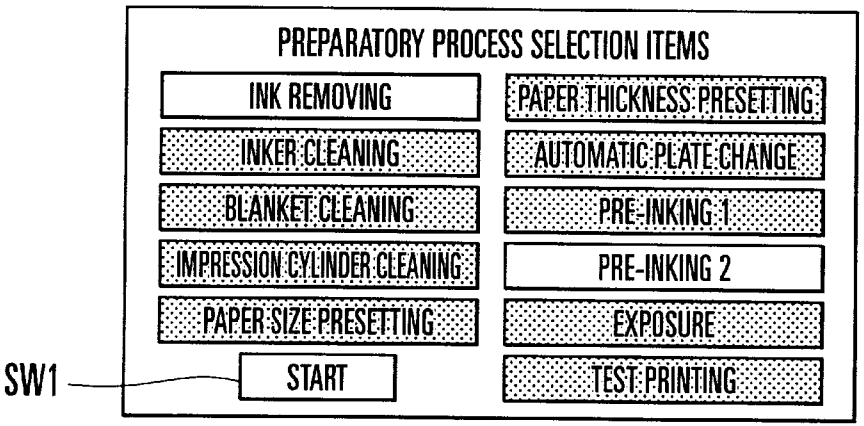
FIG. 2A is a view showing how preparatory selection items are selected.
Figure 2B:
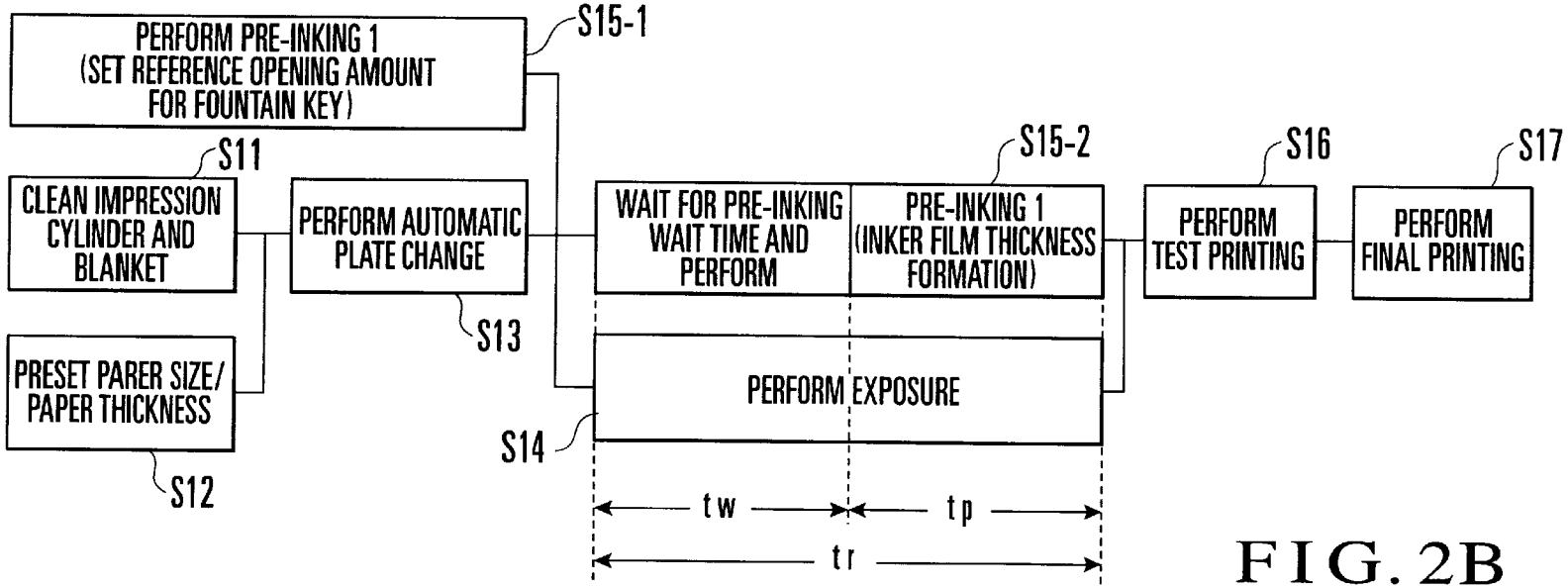
FIG. 2B is a view showing the steps in continuous processing for on-machine plate making and ink film thickness distribution formation by pre-inking 2 in accordance with the selection operation in FIG. 2A.
Figure 12B:
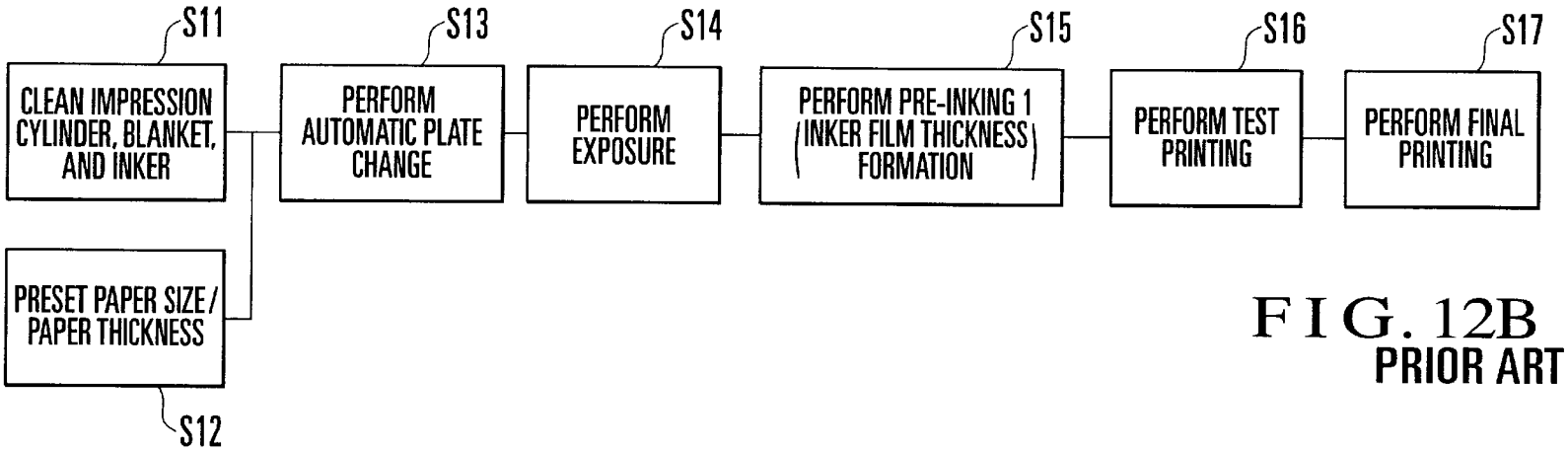
FIG. 12B PRIOR ART

FIG. 2B shows the steps in performing on-machine plate making and ink film thickness distribution formation by pre-inking 1 in combination. FIG. 2B corresponds to the conventional steps in FIG. 12B.

The operator selects and designates operations to be performed on the display. FIG. 2A shows how operations are selected by the operator. In this example, the operator has selected "inker cleaning", "blanket cleaning", "impression cylinder cleaning", "paper size presetting", "paper thickness presetting", "automatic plate change", "pre-inking 1", "exposure", and "test printing".

When the preceding printing operation is to be switched to the next printing operation, a start command is output by operating the start switch SW1, and operations corresponding to the selected items are automatically performed in a predetermined order. In the steps shown in FIG. 2B, when the start switch SW1 is pressed, the impression cylinder, blanket, and inker are automatically cleaned (step S11). Concurrently with this cleaning operation, paper size/paper thickness presetting is automatically performed (step S12). After the cleaning and presetting operations, the automatic plate change unit is driven to change the old printing plate mounted on the plate cylinder 3 to the raw plate 5 (step S13).

After the automatic plate change and exposure, ink film thickness distribution formation by pre-inking 1 is automatically performed. In this case, the exposure (step S14) and the ink film thickness distribution formation by pre-inking 1 (step S15-2) are concurrently performed, and the start timing of the ink film thickness distribution formation by pre-inking 1 is delayed to simultaneously terminate the two operations.

Presetting of the opening amount of the ink fountain key 9 to a reference opening amount (step S15-1), which is included in ink film thickness distribution formation by pre-inking 1, is performed concurrently with the preparatory process. The preparatory process includes cleaning of the impression cylinder, blanket, and inker (step S11), paper size/paper thickness presetting (step S12), and automatic plate change (step S13). An operation time (entire fountain key reference opening amount setting time) tp1 spent to preset the opening amount of the ink fountain key 9 to the reference opening amount is excluded from the time (pre-inking time) tp taken to form an ink film thickness distribution by pre-inking 1, as indicated by equation (3) to be described later.

There is a difference between the exposure time tr and the time tp taken to form an ink film thickness distribution by pre-inking 2. In general, the time tp taken to form an ink film thickness distribution by pre-inking 2 is shorter than the exposure time tr. If, therefore, exposure and ink film thickness distribution formation by pre-inking 2 are simultaneously started, the exposure is not completed even after the completion of ink film thickness distribution formation by pre-inking 2. In this case, since the printing press keeps rotating until the exposure is completed, the ink film thickness distribution changes. As a consequence, a desired ink film thickness distribution may not be obtained when the exposure is completed, and test printing may be prolonged.

In this embodiment, the start timing of ink film thickness distribution formation by pre-inking 2 is delayed to simultaneously terminate the exposure and ink film thickness distribution formation by pre-inking 2. The time tp taken to form an ink film thickness distribution by pre-inking 2 varies depending on the image area ratio of an image to be exposed on the raw plate 5. The exposure time tr is determined by the size of the raw plate 5 and a designated rotational speed in exposure.

First of all, therefore, the exposure time tr and the time tp taken to form an ink film thickness distribution by pre-inking 2 are calculated. Then, the time tp taken to form an ink film thickness distribution by pre-inking 2 is subtracted from the exposure time tr to calculate the pre-inking wait time tw (=tr−tp) between the instant at which exposure is started and the instant at which ink film thickness distribution formation by pre-inking 2 is started.

The time tp taken to form an ink film thickness distribution by pre-inking 1 is obtained from a time (fountain roller portion basic ink film thickness distribution formation time) tp2 taken for basic ink film thickness distribution formation on the ink fountain roller 8, a time (inker portion basic ink film thickness distribution formation time) tp3 taken for reference film thickness distribution formation on an ink roller group 11, the fountain key designated opening amount setting time tp4, the fountain roller portion designated ink film thickness distribution formation time tp5, and inker portion designated ink film thickness distribution formation time tp6 according to equation (3):

$$tp=tp2+tp3+tp4+tp5+tp6 \quad (2)$$

Note that the fountain roller portion basic ink film thickness distribution formation time tp2 is the value obtained by adding the time spent to preset the rotation amount of the ink fountain roller 8 to a reference rotation amount to the time spent to form an ink film having the thickness specified by the reference opening amount of the ink fountain key 9 preset in step S15-1 up to a portion on the ink fountain roller 8 which is in contact with the ink ductor roller 10. The inker portion basic ink film thickness distribution formation time tp3 is the time spent to form the basic ink film thickness distribution Ma on the ink roller group 11 by performing ink feed operation of the ink ductor roller 10 a predetermined number of times.

Figure 3:
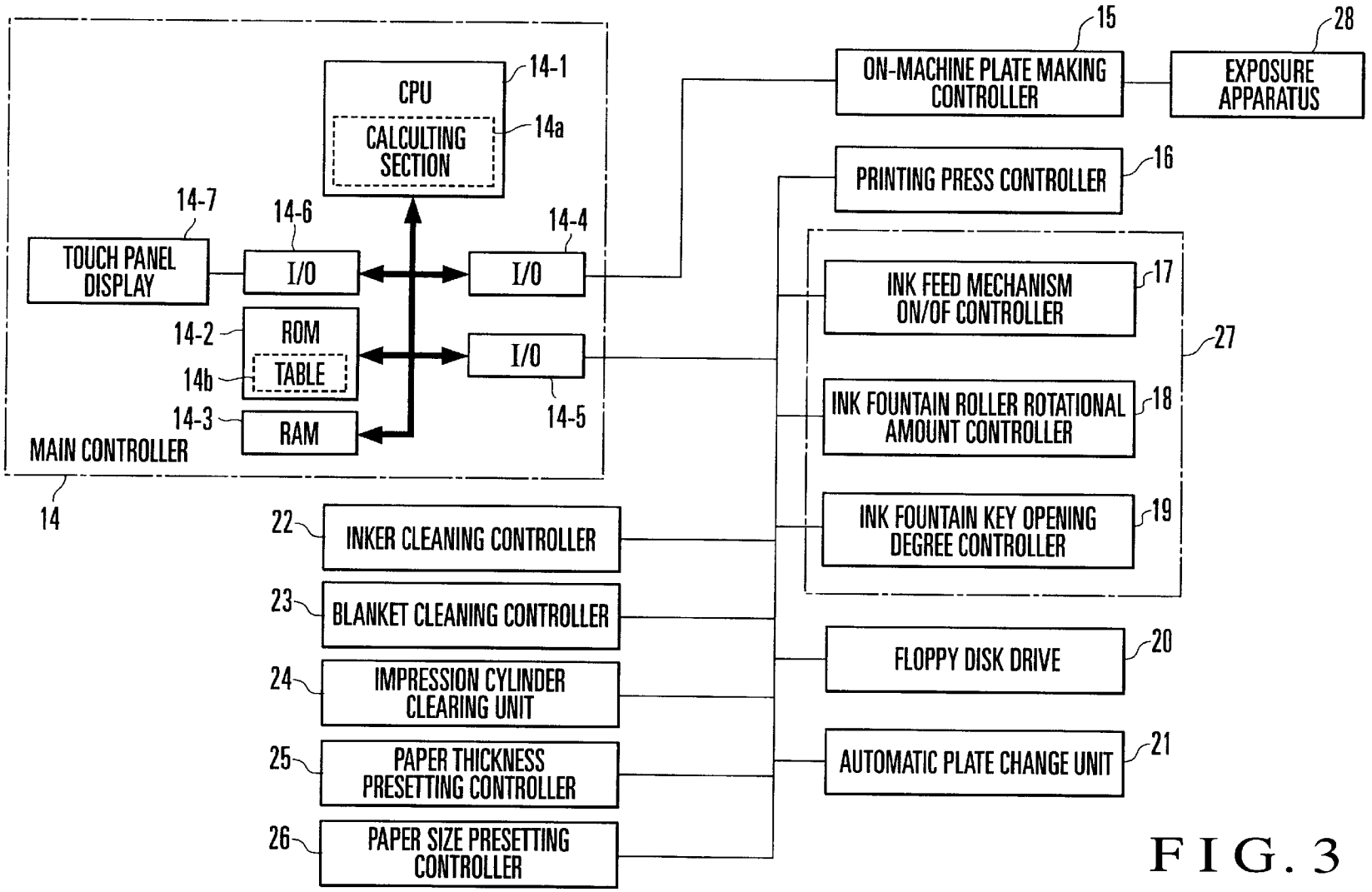
FIG. 3 is a block diagram showing a controller according to an embodiment of the present invention.

FIG. 3 shows a printing press for performing the above continuous processing according to an embodiment of the present invention. Referring to FIG. 3, reference numeral 14 denotes a main controller; 15, an on-machine plate making controller for performing plate making with respect to the raw plate 5 mounted on a plate cylinder 3 by controlling an exposure apparatus 28; 16, a printing press controller for controlling the printing operation of the printing press; 17, an ink feed mechanism ON/OFF controller (to be referred to as an ink feed controller hereinafter) for ON/OFF-controlling the ink feed operation of the ink ductor roller; 18, an ink fountain roller rotational amount controller for controlling the rotation amount of the ink fountain roller 8; 19, an ink fountain key opening degree controller for controlling the opening degree of the ink fountain key 9; 20, a floppy disk drive (to be referred to as a drive unit hereinafter) for reading out the image area ratio of the image to be exposed on the raw plate 5 from a floppy disk; 21, an automatic plate change unit for automatically change an old plate with the new plate 12, 22, an inker cleaning controller for cleaning the interior of the inker; 23, a blanket cleaning controller for cleaning the blanket; 24, an impression cylinder clearing unit for cleaning the impression cylinder; 25, a paper thickness presetting controller for presetting a paper thickness; and 26, a paper size presetting controller for presetting a paper size.

The main controller 14 includes a CPU (Central Processing Unit) 14-1, ROM (Read Only Memory) 14-2, RAM (Random Access Memory) 14-3, interfaces (I/Os) 14-4 to 14-6, and touch panel display 14-7. The CPU 14-1 includes a calculating section 14*a* for calculating the time tp according to equations (1) to (4), and also calculating the respective times tp1 to tp6, tw, and tr.

The CPU 14-1 obtains various kinds of input information supplied via the interfaces 14-4 to 14-6 and performs various operations upon accessing the RAM 14-3 in accordance with the programs stored in the ROM 14-2. Various kinds of processing information in the CPU 14-1 are output to the display 14-7, on-machine plate making controller 15, printing press controller 16, ink feed controller 17, ink fountain roller rotational amount controller 18, ink fountain key opening degree controller 19, drive unit 20, automatic plate change unit 21, inker cleaning controller 22, blanket cleaning controller 23, impression cylinder clearing unit 24, paper thickness presetting controller 25, and paper size presetting controller 26 via the interfaces 14-4 to 14-6. The ink feed controller 17, ink fountain roller rotational amount controller 18, and ink fountain key opening degree controller 19 constitute a pre-inking controller 27.

Figure 4:
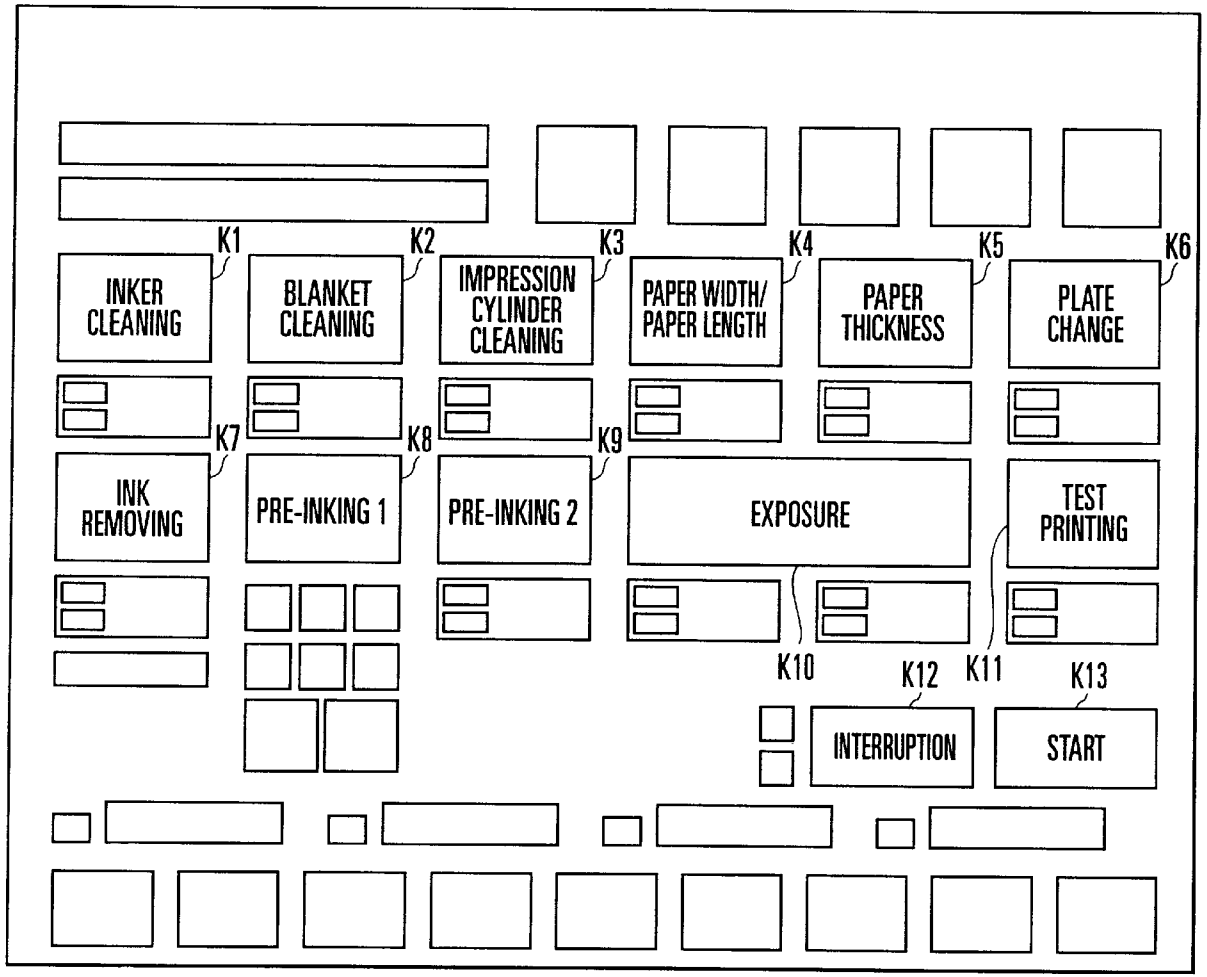
FIG. 4 is a view showing a preparatory process selection window displayed on a display in FIG. 3.

FIG. 4 shows a preparatory process selection window appearing on the display 14-7 of the main controller 14. This preparatory process selection window includes an inker cleaning key K1, blanket cleaning key K2, impression cylinder cleaning key K3, paper width/paper length set key K4, paper thickness set key K5, plate change key K6, ink removing key K7, pre-inking 1 key K8, pre-inking 2 key K9, exposure key K10, test printing key K11, interruption key K12, start key K13, and the like.

Figure 5A:
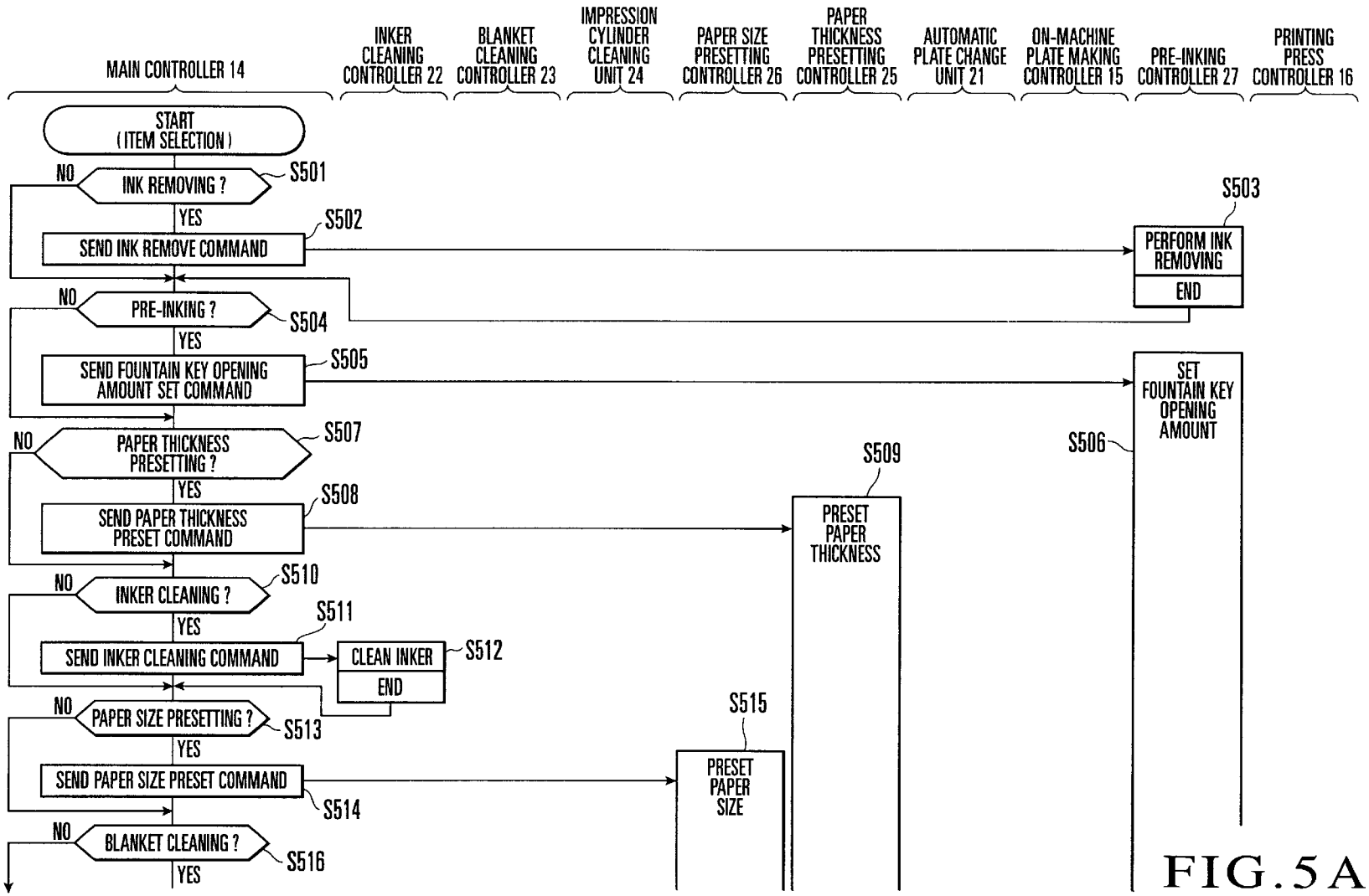
FIGS. 5A and 5B are flow charts showing continuous processing for on-machine plate making and ink film thickness distribution formation by pre-inking 1/pre-inking 2.
Figure 5B:
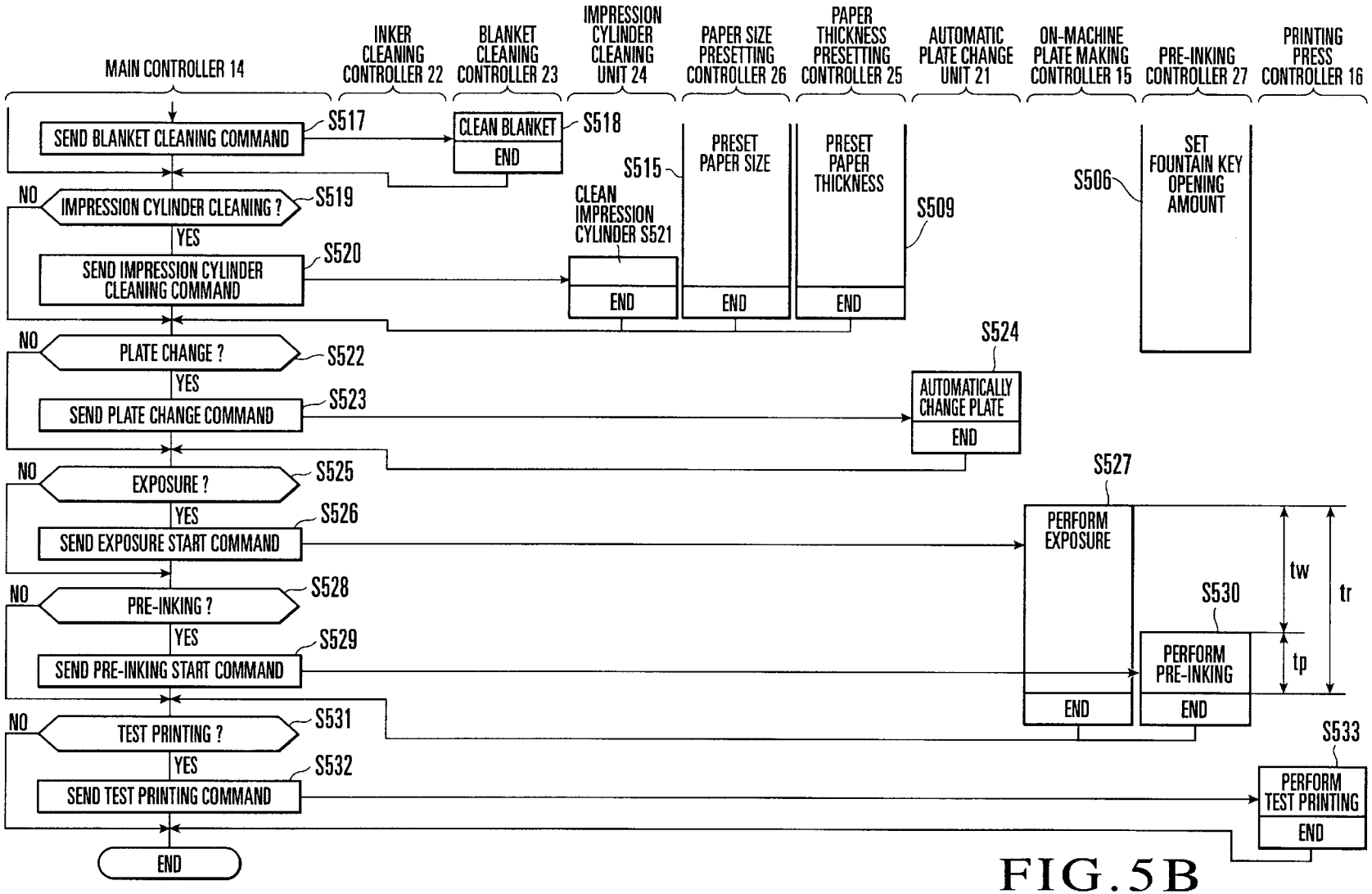

Each of FIGS. 5A and 5B shows a series of steps in performing on-machine plate making and ink film thickness distribution formation by pre-inking (pre-inking 1 or 2) in combination. Each of FIGS. 5A and 5B mainly shows the processing performed by the main controller 14.

[On-machine Plate Making+Pre-inking 2]

The operator selects and designates operations to be performed on the preparatory process selection window in FIG. 4. When the "on-machine plate making+pre-inking 2" processing shown in FIG. 1B is to be performed, the operator presses the blanket cleaning key K2, impression cylinder cleaning key K3, paper width/paper length set key K4, paper thickness set key K5, plate change key K6, ink removing key K7, pre-inking 2 key K9, exposure key K10, and test printing key K11. After this operation selection, the operator presses the start key K13, and the CPU 14-1 stores the operation selected/designated state on the preparatory process selection window in the RAM 14-3. The CPU 14-1 automatically proceeds with the operations along the flow charts shown in FIGS. 5A and 5B, while referring to the operation selected/designated state stored in the RAM 14-3, in accordance with the programs stored in the ROM 14-2.

First of all, the CPU 14-1 checks whether ink removing is selected (step S501). In this case, since the ink removing key K7 is pressed, the CPU 14-1 sends an ink removing command to the pre-inking controller 27 (step S502). In response to this command, ink removing is performed while the old printing plate 12 is mounted on the plate cylinder 3 (step S503). With this operation, the basic ink film thickness distribution Ma which decreases in thickness from upstream to downstream is left on the ink roller group 11. The operation in step S503 corresponds to that in step S21 in FIG. 1B.

After ink removing, it is determined that pre-inking 2 is selected (step S504). Upon determining that the pre-inking 2 key K9 is pressed, the CPU 14-1 sends a fountain key opening amount set command for final printing to the pre-inking controller 27 (step S505). With this operation, the opening amount of the ink fountain key 9 is preset to a value corresponding to the image to be exposed on the raw plate 5 (step S506). It is then determined that paper thickness presetting is selected (step S507). That is, upon determining that the paper thickness set key K5 is pressed, the CPU 14-1 sends a paper thickness preset command to the paper thickness presetting controller 25 (step S508). With this operation, a paper thickness is preset (step S509). It is then checked whether inker cleaning is selected (step S501). In this case, since inker cleaning is not selected, i.e., the inker cleaning key K1 is not pressed, the flow advances to the next step.

It is determined that paper size presetting is selected (step S513). That is, upon determining that the paper width/paper length set key K4 is pressed, the CPU 14-1 sends a paper size preset command to the paper size presetting controller 26 (step S514). With this operation, a paper size is preset (step S515). It is determined that blanket cleaning is selected (step S516). That is, upon determining that the blanket cleaning key K2 is pressed, the CPU 14-1 sends a blanket cleaning command to the blanket cleaning controller 23 (step S517). With this operation, the blanket is cleaned (step S518). It is determined that an impression cylinder cleaning is selected/designated (step S519). That is, upon determining that the impression cylinder cleaning key K3 is pressed, the CPU 14-1 sends an impression cylinder cleaning command to the impression cylinder clearing unit 24 (step S520). With this operation, the impression cylinder is cleaned (step S521).

When paper thickness presetting in step S509, paper size presetting in step S515, and impression cylinder cleaning in step S521 are completed, it is determined that plate change is selected (step S522). That is, upon determining that the plate change key K6 is pressed, the CPU 14-1 sends a plate change command to the automatic plate change unit 21 (step S523). With this operation, the old printing plate is changed to the raw plate 5 (step S524).

The operation in steps S518 and S521 corresponds to that in step S22 in FIG. 1B. The operation in steps S509 and S515 corresponds to that in step S23. The operation in step S524 corresponds to that in step S25. The operation in step S506 corresponds to that in step S26-1.

After plate change in step S524, it is determined that exposure is selected (step S525). That is, upon determining that the exposure key K10 is pressed, the CPU 14-1 sends an exposure start command to the on-machine plate making controller 15 (step S526). Exposing of the image on the raw plate 5 is started (step S527). It is then determined that pre-inking 2 is selected (step S528). That is, upon determining that the pre-inking 2 key K9 is pressed, the CPU 14-1 sends a pre-inking 2 start command to the pre-inking controller 27 when the pre-inking wait time tw has elapsed after the start of exposure (step S529). In response to this start command, the pre-inking controller 27 performs ink film thickness distribution formation by pre-inking 2 (step S530). The operation in steps S527 and S530 corresponds to that in steps S25 and S26-2 in FIG. 1B.

Figure 6:
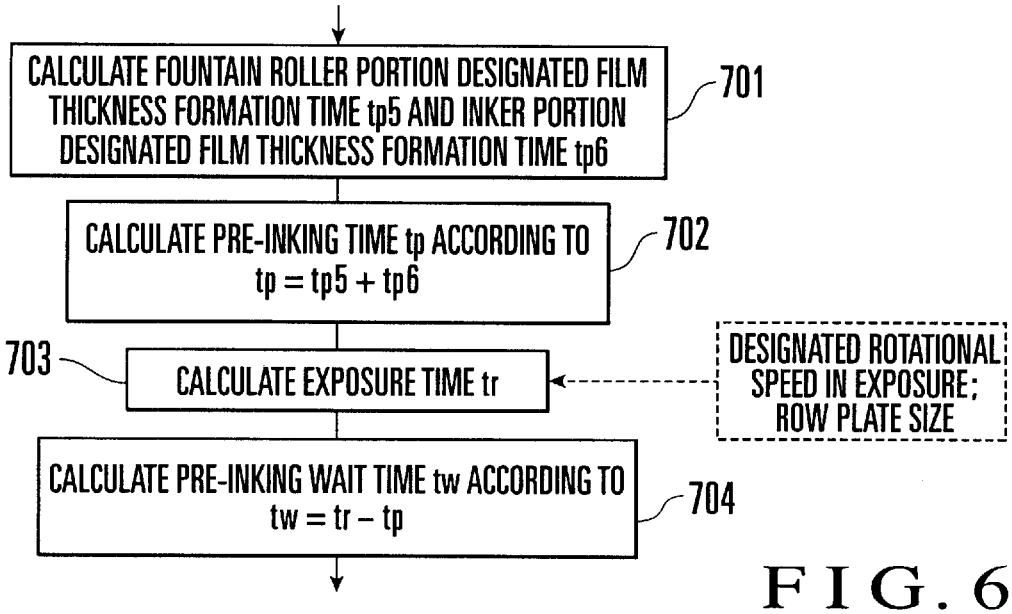
FIG. 6 is a flow chart showing calculation processing for a pre-inking wait time tw in the execution of pre-inking 2.

FIG. 6 shows the operation of calculating the pre-inking wait time tw. The calculating section 14*a* of the CPU 14-1 calculates the fountain roller portion designated ink film thickness distribution formation time tp5 an inker portion designated ink film thickness distribution formation time tp6 (step S701), and calculates the time tp (=tp5+tp6) taken to form an ink film thickness distribution by pre-inking 2 by using the calculation results (step S702). The exposure time tr is then calculated from the designated rotational speed in exposure and the size of the raw plate 5 (step S703). The pre-inking wait time tw (=tr−tp) between the instant at which exposure is started and the instant at which ink film thickness distribution formation by pre-inking 2 is started is calculated by subtracting the time tp taken to form an ink film thickness distribution by pre-inking 2 from the exposure time tr (step S704).

When the exposure is completed, the on-machine plate making controller 15 sends an exposure end signal to the CPU 14-1. When the ink film thickness distribution formation by pre-inking 2 is completed, the pre-inking controller 27 sends a pre-inking 2 end signal to the CPU 14-1. Upon reception of the exposure end signal from the on-machine plate making controller 15 and the pre-inking 2 end signal from the pre-inking controller 27, the CPU 14-1 determines that test printing is selected (step S531). That is, upon determining that the test printing key K11 is selected, the CPU 14-1 sends a test printing command to the printing press controller 16 (step S532). With this operation, test printing is started (step S533). If a satisfactory tone is obtained in this test printing, the flow advances to final printing.

[On-machine Plate Making+Pre-inking 1]

The operator selects and designates operations to be performed on the preparatory process window shown in FIG. 4. When the "on-machine plate making+pre-inking 1" processing shown in FIG. 2B is to be performed, the operator presses the inker cleaning key K1, blanket cleaning key K2, impression cylinder cleaning key K3, paper width/paper length set key K4, paper thickness set key K5, plate change key K6, pre-inking 1 key K8, exposure key K10, and test printing key K11. After this selection, the operator presses the start key K13. Then, the CPU 14-1 automatically proceeds with the processing along the flow charts shown in FIGS. 5A and 5B in accordance with the operation selected state on the preparatory process selection window.

First of all, the CPU 14-1 checks whether ink removing is selected (step S501). Since the ink removing key K7 is not pressed, i.e., ink removing is not selected, the CPU 14-1 determines that pre-inking 1 is selected (step S504). That is, upon determining that the pre-inking 1 key K8 is pressed, the CPU 14-1 sends an entire surface fountain key opening amount set command to the pre-inking controller 27 (step S505). With this operation, the opening amount of each of the fountain keys 9-1 to 9-n is preset to a reference opening amount (step S506). The CPU 14-1 then determines that paper thickness presetting is selected (step S507), and sends a paper thickness preset command to the paper thickness presetting controller 25 (step S508). With this operation, a paper thickness is preset (step S509).

The CPU 14-1 determines that inker cleaning is selected (step S510), and sends an inker cleaning command to the inker cleaning controller 22 (step S511). With this operation, the inker is cleaned (step S512). After inker cleaning, the CPU 14-1 determines that paper size presetting is selected (step S513), and sends a paper size preset command to the paper size presetting controller 26 (step S514). With this operation, a paper size is preset (step S515). The CPU 14-1 determines that blanket cleaning is selected (step S516), and sends a blanket cleaning command to the blanket cleaning controller 23 (step S517). With this operation, the blanket is cleaned (step S518). After this blanket cleaning operation, the CPU 14-1 determines that impression cylinder cleaning is selected (step S519), and sends an impression cylinder cleaning command to the impression cylinder clearing unit 24 (step S520). With this operation, the impression cylinder is cleaned (step S521).

After paper thickness presetting in step S509, paper size presetting in step S515, and impression cylinder cleaning in step S521, the CPU 14-1 determines that plate change is selected (step S521), and sends a plate change command to the automatic plate change unit 21 (step S522). With this operation, the old printing plate is changed to the raw plate 5 (step S523).

The operation in steps S512, S518, and S521 corresponds to that in step S11 in FIG. 2B. The operation in steps S509 and S515 corresponds to that in step S12. The operation in step S523 corresponds to that in step S13. The operation in step S506 corresponds to that in step S15-1.

When plate change is terminated in step S523, the CPU 14-1 determines that exposure is selected/designated (step S524), and sends an exposure start command to the on-machine plate making controller 15 (step S525). With this operation, exposing of an image on the raw plate 5 is started (step S526). The CPU 14-1 determines that pre-inking 1 is selected (step S527), and sends a pre-inking 1 command to the pre-inking controller 27 when the pre-inking wait time tw has elapsed after the start of exposure (step S528). Upon reception of this start command, the pre-inking controller 27 performs ink film thickness distribution formation by pre-inking 1 (step S529). The operation in steps S526 and S259 corresponds to that in steps S14 and S15-2 in FIG. 2B.

Figure 7:
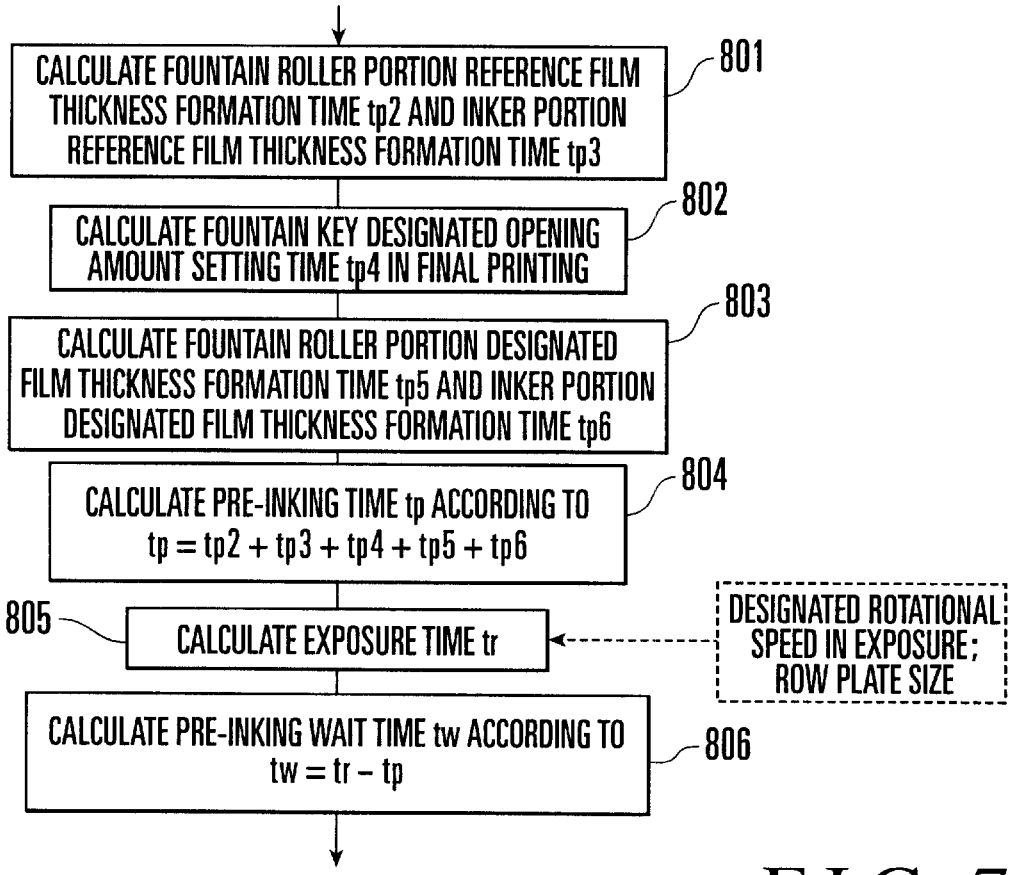
FIG. 7 is a flow chart showing calculation processing for a pre-inking wait time tw in the execution of pre-inking 1.

FIG. 7 shows the steps in calculating the pre-inking wait time tw. The calculating section 14*a* of the CPU 14-1 calculates the fountain roller portion basic ink film thickness distribution formation time tp2 and inker portion basic ink film thickness distribution formation time tp3 (step S801). In addition, the fountain key designated opening amount setting time tp4 is calculated (step S802), and the fountain roller portion designated ink film thickness distribution formation time tp5 and inker portion designated ink film thickness distribution formation time tp6 are calculated (step S803). The time tp (=tp2+tp3+tp4+tp5+tp6) taken to form an ink film thickness distribution by pre-inking 1 is calculated by using these calculation results (step S804). The exposure time tr is then calculated from the designated rotational speed in exposure and the size of the raw plate 5 (step S805). The pre-inking wait time tw (=tr−tp) between the instant at which exposure is started and the instant at which ink film thickness distribution formation by pre-inking 1 is started is calculated by subtracting the time tp taken to form an ink film thickness distribution by pre-inking 1 from the calculated exposure time tr (step S806).

When exposure is completed, the on-machine plate making controller 15 sends an exposure end signal to the CPU 14-1. When the ink film thickness distribution formation by pre-inking 1 is completed, the pre-inking controller 27 sends a pre-inking 1 end signal to the CPU 14-1. Upon reception of the exposure end signal from the on-machine plate making controller 15 and the pre-inking 1 end signal from the pre-inking controller 27, the CPU 14-1 determines that test printing is selected (step S530), and sends a test printing command to the printing press controller 16 (step S531). With this operation, test printing is started (step S532). If a satisfactory tone is obtained in this test printing, the flow advances to final printing.

In the above embodiment, exposure and ink film thickness distribution formation by pre-inking 1/pre-inking 2 are simultaneously terminated. However, they need not always be terminated simultaneously. That is, after exposure, ink film thickness distribution formation by pre-inking 1/pre-inking 2 may be terminated with a slight delay. Alternatively, after ink film thickness distribution formation by pre-inking 1/pre-inking 2, exposure may be terminated with a slight delay.

In addition, in the above embodiment, as shown in FIGS. 1B and 2B, the opening amount of the ink fountain key 9 is preset to a value corresponding to the image to be printed on the raw plate 5 during a preparatory process. However, this presetting operation may be performed concurrently with the exposure after the preparatory process. In this case, as in the cases shown in FIG. 1B and 2B, the fountain key designated opening amount setting times tp4 and tp1 spent to preset the opening amount of the ink fountain key 9 to a value corresponding to the image to be exposed on the raw plate 5 may be included in the pre-inking time tp.

In the above embodiment, the operator individually selects the respective operations constituting a preparatory process on the display, and an operation order is determined in accordance with the combination of the selected operations. However, operations required for a preparatory process and the operation order may be automatically set. If, for example, the operator presses the "on-machine plate making+pre-inking 2" start switch, operations required for "on-machine plate making+pre-inking 2" may be automatically performed in a predetermined order. In this case, operations required for preparatory processes corresponding to various start switches and corresponding operation orders may be stored in the table 14*b* of the ROM 14-2 in advance.

In the above embodiment, the operation of each device is started when the operator operates the start switch SW1. However, the operation of each device may be automatically started. For example, the selected/designated state of each device is stored in a host device in advance, and the operation of each device may be automatically started in accordance with an print end signal from the printing press controller.

In the above embodiment, an automatic plate change unit is disclosed in Japanese Patent Laid-Open No. 02-258993; an inker cleaning unit, in Japanese Patent Laid-Open Nos. 10-193578 and 10-286944; a blanket cleaning unit, in Japanese Patent Laid-Open Nos. 05-200995 and 09-39215; an impression cylinder cleaning unit, in Japanese Patent Laid-Open Nos. 02-286245 and 03-114748; a paper size presetting unit, in Japanese Patent Laid-Open No. 63-127923; and a paper thickness presetting unit, in Japanese Patent Laid-Open No. 63-134244. The techniques disclosed in these references are incorporated in this specification.

As has been described above, according to the present invention, when switching operation is performed to switch the preceding printing operation to the next printing operation, the blanket cleaning unit, plate change unit, image exposing unit, and ink film thickness distribution forming unit automatically operate in a predetermined order. This makes it possible to reduce the load on the operator and shorten the time required to start final printing.

In addition, according to the present invention, when the blanket cleaning unit, plate change unit, image exposing unit, and ink film thickness distribution forming unit are selected in advance, and switching operation is performed to switch to the next printing operation, the selected units automatically operate in a predetermined order. This makes it possible to reduce the load on the operator and shorten the time required to start final printing.

Note that the predetermined order includes not only an operation order when the respective units are sequentially operated but also an operation order when a plurality of units are concurrently operated.

What is claimed is:

1. A printing press comprising:

blanket cleaning means for cleaning a blanket mounted on a blanket cylinder;

plate change means for changing a printing plate mounted on a plate cylinder with a new printing plate;

image exposing means for exposing an image on the printing plate mounted on the plate cylinder;

ink film thickness distribution formation means for forming, on an ink roller group, an ink film thickness distribution corresponding to an image to be exposed next; and control means for automatically driving said blanket cleaning means, said plate change means, said image exposing means, and said ink film thickness distribution formation means in an operation order set by a single start command.

2. A press according to claim 1, wherein said press further comprises operation selecting means for selecting operations performed by said blanket cleaning means, said plate change means, said image exposing means, and said ink film thickness distribution formation means, and said control means automatically drives at least two of said blanket cleaning means, said plate change means, said image exposing means, and said ink film thickness distribution formation means in a set order in accordance with the selection result obtained from said operation selecting means.

3. A press according to claim 2, wherein said press comprises a table in which a combination of operations performed by said blanket cleaning means, said plate change means, said image exposing means, and said ink film thickness distribution formation means and an operation order corresponding to the combination are stored in advance, and said control means determines an operation order corresponding to a combination of selected operations by looking up said table.

4. A press according to claim 1, wherein said press comprises a table in which a combination of operations performed by said blanket cleaning means, said plate change means, said image exposing means, and said ink film thickness distribution formation means which are required for continuous processing of on-machine plate making, first pre-inking, and second pre-inking and an operation order corresponding to the combination are stored in advance, and said control means automatically drives said plate change means, said image exposing means, and said ink film thickness distribution formation means in a set order by looking up said table when one of continuous processing of on-machine plate making and first pre-inking and continuous processing of on-machine plate making and second pre-inking is designated.

5. A control method for a printing press, comprising the steps of:

cleaning a blanket mounted on a blanket cylinder;

changing a printing plate mounted on a plate cylinder to a new printing plate;

exposing an image on the printing plate mounted on the plate cylinder;

forming, on an ink roller group, an ink film thickness distribution corresponding to an image to be exposed next; and automatically performing blanket cleaning, plate change, image exposing, and ink film thickness distribution formation in an operation order set by a single start command.

6. A method according to claim 5, wherein the method further comprises the step of selecting blanket cleaning, plate change, image exposing, and ink film thickness distribution formation, and the step of automatically performing blanket cleaning, plate change, image exposing, and ink film thickness distribution formation comprises the step of automatically performing at least two of blanket cleaning, plate change, image exposing, and ink film thickness distribution formation in a set order in accordance with selection result.

7. A method according to claim 6, further comprising the step of determining an operation order corresponding to a combination of selected operations by looking up a table in which a combination of blanket cleaning, plate change, image exposing, and ink film thickness distribution formation and an operation order corresponding to the combination are stored in advance.

* * * * *